United States Patent [19]

Morris et al.

[11] Patent Number: 4,694,908

[45] Date of Patent: Sep. 22, 1987

[54] METHOD AND APPARATUS OF INJECTING FLUID INTO A WELL CONDUIT BY COIL TUBING

[75] Inventors: Arthur J. Morris, Magnolia, Tex.; Donald E. Newton, Marrero, La.

[73] Assignee: Camco, Incorporated, Houston, Tex.

[21] Appl. No.: 923,452

[22] Filed: Oct. 27, 1986

[51] Int. Cl.[4] ..... E21B 43/00

[52] U.S. Cl. ..... 166/310; 166/902

[58] Field of Search ..... 166/310, 311, 312, 374, 166/386, 902, 319

[56] References Cited

U.S. PATENT DOCUMENTS

| | | | |
|---|---|---|---|
| 2,654,436 | 10/1953 | Carlisle et al. | 166/310 |
| 3,566,970 | 3/1971 | Crow et al. | 166/902 |
| 3,901,313 | 8/1975 | Doniguian et al. | 166/902 |
| 4,031,955 | 6/1977 | Ledet | 166/902 |
| 4,216,249 | 8/1980 | Clayton | 166/902 |
| 4,256,282 | 3/1981 | Goldschild et al. | 166/902 |
| 4,326,585 | 4/1982 | McStravick | 166/902 |
| 4,347,899 | 9/1982 | Weefer | 166/902 |
| 4,421,166 | 12/1983 | Cain | 166/164 |

FOREIGN PATENT DOCUMENTS

| | | | |
|---|---|---|---|
| 0604970 | 4/1978 | U.S.S.R. | 166/902 |

*Primary Examiner*—Stephen J. Novosad
*Assistant Examiner*—William P. Neuder
*Attorney, Agent, or Firm*—Fulbright & Jaworski

[57] ABSTRACT

Injecting fluid by inserting a coil tubing having a fluid outlet and a valve above the outlet into a well conduit, biasing the valve to a closed position with a sufficient force to at least balance the hydrostatic force of injection fluid in the tubing, inserting a fluid to be injected in the conduit, and pressurizing the fluid in the coil tubing for opening the valve and injecting the fluid through the fluid outlet. The fluid is ejected in a circumferential direction from the tubing and the tubing may be moved relative to the well conduit while injecting. The upward flow of well fluids in the well conduit may be used to disperse the injected fluid around the interior of the well conduit. The interior of the well conduit may be wiped after injecting the fluid for more evenly spreading the injected fluid. An ejector is connected to the bottom of the coil tubing which initially overbalances the hydrostatic force of the fluid in the coil tubing and opens by injection pressure.

10 Claims, 7 Drawing Figures

METHOD AND APPARATUS OF INJECTING FLUID INTO A WELL CONDUIT BY COIL TUBING

BACKGROUND OF THE INVENTION

Coil tubing services can be used instead of expensive workover rigs for efficiently and economicaly performing a wide variety of production, completion and workover problems in producing oil and/or gas wells or injection wells. Coil tubing services reduce well down time and, reduce costs, by performing many types of operations, and can perform the operations without killing the well. Coil tubing operations are performed by inserting a flexible tubing, which is normally coiled on a reel, into a well conduit and fluids are inserted into the coil tubing under pressure to perform various mechanical and chemical functions. For example, a well conduit may be washed, coated with corrosion inhibitors, coated with a protective film for increasing the life of the well conduit instead of replacing it, removing paraffin with chemicals, perform acid treatments and many other operations.

However, in treating and/or coating well conduits in the past, it has been difficult to obtain an even and complete contact of the interior of the well conduit with the injected fluids. First, the hydrostatic head of the fluids in the coil tubing diminishes the ability to accurately control the volume of the injected fluids at the desired locations. Secondly, the present systems do not insure a thorough circumferential coating of the well conduit with the injected fluids.

The present invention is directed to a method and apparatus of injecting fluid into a well conduit by coil tubing which overcomes the problems of the prior art by providing a complete and controlled contact of the interior of the well conduit with the injecting fluid.

SUMMARY

The present invention is directed to a method and apparatus of injecting fluid into a well conduit by coil tubing which includes inserting a coil tubing, having a fluid outlet and a valve positioned above the outlet, into the well conduit and biasing the valve to the closed position with a sufficient force to at least balance the hydrostatic force of the injection fluid placed in the tubing. The fluid to be injected is inserted into the coil tubing and pressurized in the coil tubing for opening the valve and ejecting the fluid through the fluid outlet. Thus the amount of fluid ejected can be accurately controlled by controlling the pressure exerted in the coil tubing from the well surface.

Still a further object of the present invention is the provision of a method and apparatus for injecting the fluid from the outlet in a circumferential direction from the tubing to entirely and fully coat the interior circumference of the well conduit.

Yet a still further object of the present invention includes vertically moving the fluid outlet relative to the well conduit while injecting the fluid into the conduit.

Still a further object of the present invention is the provision of using upwardly flowing well fluids in the well conduit for dispersing the injection fluids circumferentiallly around the interior of the well conduit.

Yet a still further object of the present invention includes wiping the interior of the well conduit after injecting the fluid from the fluid outlet for more evenly spreading the injected fluid on the interior of the well conduit if required.

A still further object of the present invention is the provision of an ejector valve for use on coil tubing for injecting fluid into the well conduit which includes a body having connecting means for connecting to a coil tubing. The body includes a flow passageway for receiving injection fluid from the coil tubing and a fluid outlet connected to the fluid passageway. A piston actuated value is positioned in the fluid passageway upstream of the fluid outlet and biasing means, such as gas and/or springs, acts on the valve in a direction to close the valve. The piston is subject to fluid pressure in the fluid passageway acting in a direction to open the valve. The fluid outlet is directed outwardly from the body around the body circumference for circumferentially spraying the interior circumference of a well conduit.

For example, a turbine wheel may be positioned in the fluid outlet and rotated by fluid flow through the open valve for rotatably dispersing the fluid. A further object is wherein a well fluid passageway is provided in the body in communication with a turbine wheel for allowing upwardly flowing well fluids in the well conduit to rotate the wheel.

A further object is the provision of an upwardly directed cup means connected to the body for engaging the well conduit for receiving and evenly spreading the injected fluid over the interior of the well conduit as the body is moved relative to the well conduit.

Other and further objects, features and advantages will be apparent from the following description of a presently preferred embodiment of the invention, given for the purpose of disclosure and taken in conjunction with the accompanying dawings.

DESCRIPTON OF THE PREFERRED EMBODIMENT

Figure 1:
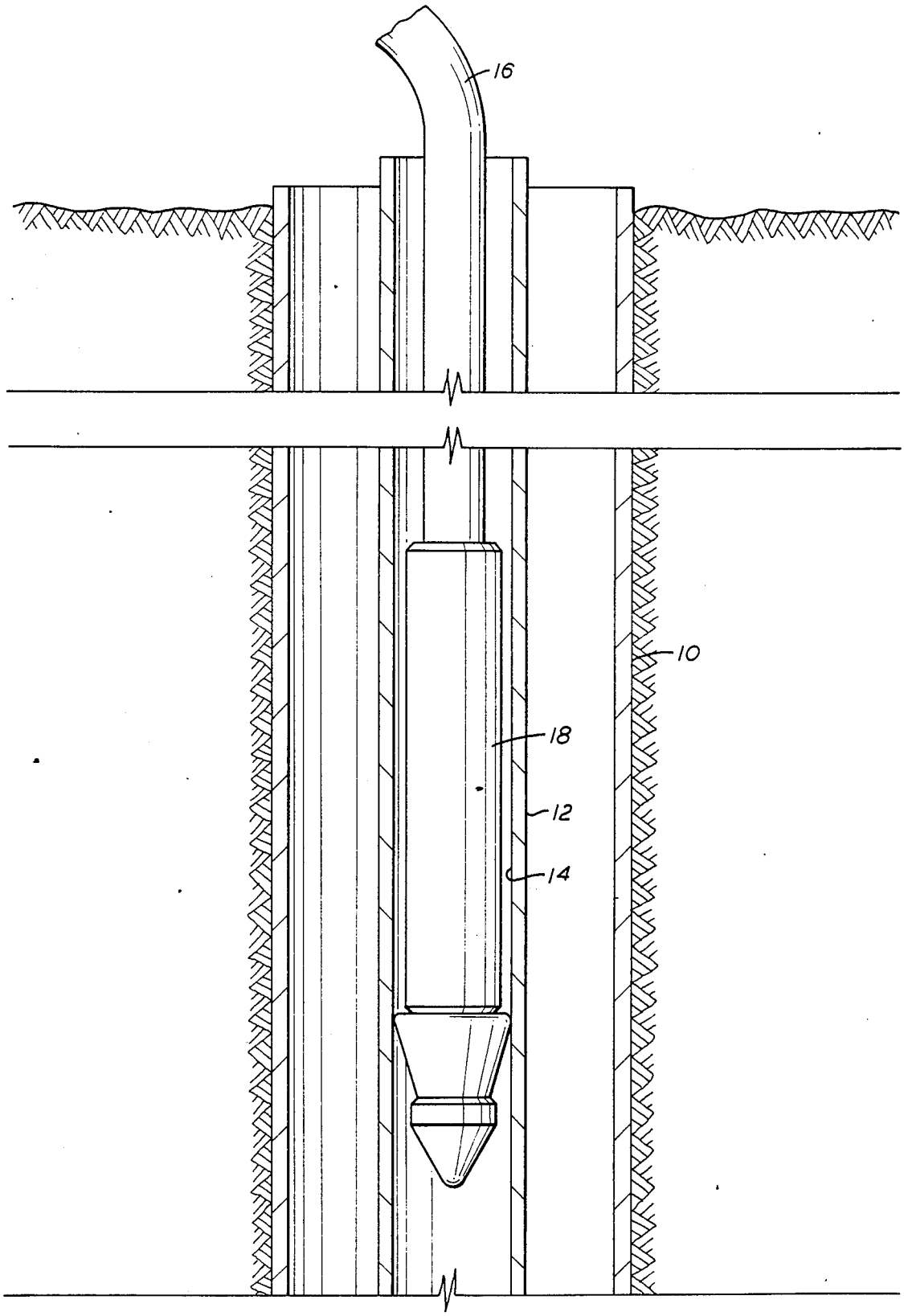
FIG. 1 is a schematic elevational view of the use of the present invention in a well conduit.

Referring now to FIG. 1, a typical cross section of an oil and/or gas well is shown having a casing 10, a well conduit 12 such as a production tubing in which it is desired to treat or coat the interior 14 with an injecting fluid for coating or treating the interior 14 for various reasons. A coil tubing 16, which is a conventional flexible tubing, generally carried in a coil position on a reel. The tubing 16 is inserted into the well conduit 12 and includes an injector 18 connected to its lower end. When pressurized injecting fluid is inserted into the coil tubing 16, the injector 18 will receive the pressurized fluid and direct it on to the interior 14 of the well conduit 12.

However, in the past, the injecting fluid has not been able to be fully controlled as to volume, coating thickness, or coating coverage. One problem is that the hydrostatic head of the injecting fluid in the tubing 16 varies with the depth of the injector 18 in the conduit 12 and affects the pressure at the injector and thus the volume of fluid being injected. Additionally, prior art injectors did not insure an even circumferential coating of the interior 14 of the well conduit 12.

Figure 2:
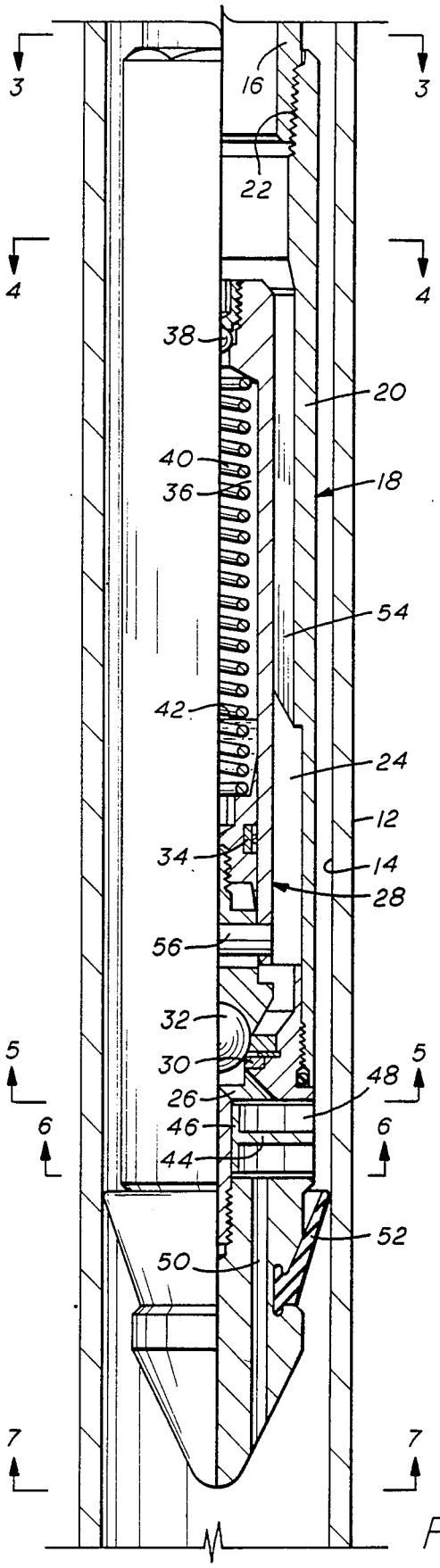
FIG. 2 is an enlarged elevational view, in cross section, of one form of the injection valve of the present invention.
Figure 3:
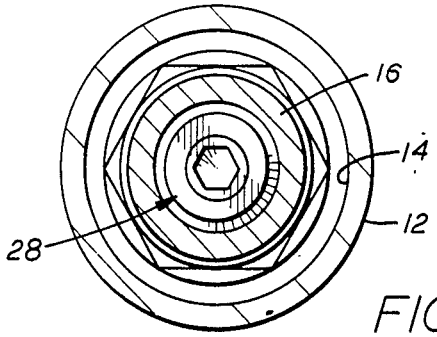
FIG. 3 is a cross-sectional view taken along the line 3—3 of FIG. 2.
Figure 4:
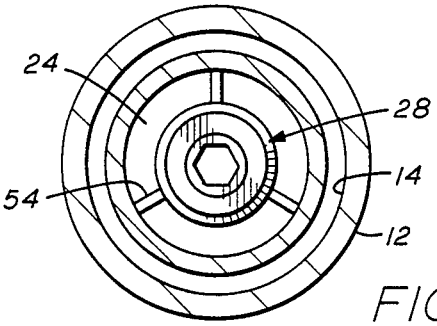
FIG. 4 is a cross-sectional view taken along the line 4—4 of FIG. 2.
Figure 5:
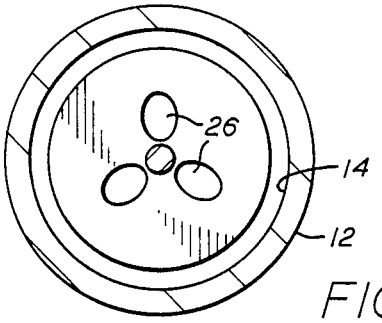
FIG. 5 is a cross-sectional view taken along the line 5—5 of FIG. 2.
Figure 6:
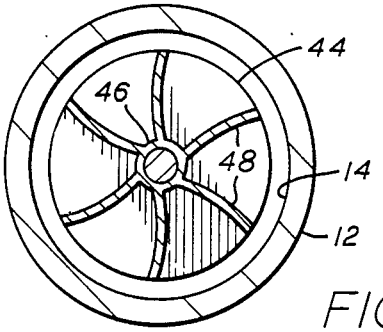
FIG. 6 is a cross-sectional view taken along the line 6—6 of FIG. 2.
Figure 7:
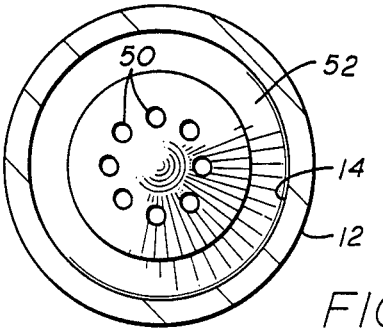
FIG. 7 is a cross-sectional view taken along the line 7—7 of FIG. 2.

Referring now to FIG. 2, the injector 18 of the present invention is best seen and includes a body 20 having connecting means such as threads 22 for connection to the coil tubing 16. The body 20 includes a fluid passageway 24 for receiving injecting fluid from the tubing 16 and includes a fluid outlet 26 connected to the passageway 24 for directing the injecting fluid on to the interior 14 of the well conduit 12.

A piston actuated valve generally indicated by the reference numeral 28 is positioned in the fluid passageway 24 upstream of the fluid outlet 26. The valve 28 includes a valve seat 30, and a valve element 32 which is connected to a piston 34. The piston 34 is subject to fluid pressure in the fluid passageway 24 acting in a direction to move the valve element 32 off of the valve seat 30 to open the valve 28.

Biasing means are provided acting on the valve element 32 in a direction to yieldably urge the valve element 32 on to the seat 30 and close the valve 28. Preferably, the biasing means includes a gas charging chamber 36 which may be charged with a gas such as nitrogen through a chamber inlet 38. The gas charge in the chamber 36 acts against the backside of the piston 34. In addition, a spring 40 may be provided as the biasing force or as a fail-safe closure if nitrogen is lost. Preferably, the charged chamber 36 includes oil 42 positioned above the piston 34 for assisting in preventing leakage of nitrogen from the charge chamber 36. The purpose of the biasing force is to provide a force sufficient to at least balance the hydrostatic force of the injection fluid in the tubing 16. This allows the valve 28 to be controlled by the pressure exerted at the well surface to the fluid in the coil tubing 16 for more accurately controlling the amount of fluid injected against the wall interior 14. Therefore, depending upon the depth in the well at which the injector 18 is to be nitiated, the biasing force can be easily set by the pressure charge of the nitrogen in the chamber 36 and/or the strength of the spring 40.

The fluid outlet or outlets 26 are directed outwardly from the body 18 and around the body circumference for circumferentially spraying the interior circumference 14 of the well conduit 12. While the outlet 26 may be a plurality of fixed nozzles, a turbine impeller 44 is the preferred embodiment which rotates on a bearing 46 and includes a plurality of turbine blades 48. Thus, fluid from the outlet 26 strike the blades 48, rotates the impeller 44 and insures a circumferential coating on the interior 14 of the well conduit 12. If desired, a well fluid passageway 50 may be provided in the body 18 in communication with the bottom of the turbine impeller 44 whereby upwardly flowing well fluids in the well conduit 12 will enter the passageway 50, engage the impeller 44 and aid in the rotative action of the impeller 44.

If desired, an upwardly directly flexible cup 52 may be provided connected to the body 20 and engaging the interior 14 of the well conduit 12. The cup 52 functions to trap injection fluid thereabove and as the body 18 is moved axially in the well conduit 12, the cup 52 will further insure that the injecting fluid covers all of the interior 14 and will wipe the interior 14 to provide an even and smooth coating. It is to be noted that the cup 52 is directed upwardly so as to allow any upwardly flowing well fluids, such as gas, to pass up the well conduit 12 in the annulus between the exterior of the body 20 and the interior 14 of the well conduit 12 in the event that the fluid passageway 50 is overloaded. Therefore, the injector 18 can be used in a producing well without killing the well or interfering with production therethrough.

It is to be noted that the valve 28 is an insert which is inserted into the interior of the body 18 between ribs 54 for ease of replacement and service. The valve 28 also includes a pin 56 for limiting the movement of the piston 34 in the insert when charging the chamber 36.

The method of the present invention includes inserting a coil tubing, having a fluid outlet and a valve above the outlet, into the well conduit adjacent to where the fluid is to be injected, and biasing the valve to a closed position with a sufficient force to at least balance the hydrostatic force of the injecting fluid placed in the tubing. After inserting a fluid to be injected into the coil tubing, the fluid is pressurized in the coil tubing for opening the valve and ejecting the fluid through the fluid outlet. The method includes injecting the fluid from the outlet in a circumferential direction from the tubing and vertically moving the fluid outlet relative to the well conduit while injecting the fluid into the conduit. The method may further include using upwardly flowing well fluids in the well conduit for dispersing the injected fluids circumferentially around the interior of the wall conduit. The method may further include wiping the interior of the well conduit after injecting the fluid from the fluid outlet for more evenly spreading the injected fluid on to the interior of the well conduit.

The method may further include a turbine impeller positioned in the fluid outlet, and rotating the turbine impeller by fluid flow through the open valve for rotatatively dispersing the fluid. The method includes a piston actuated valve which is operated by biasing the piston by a gas charge for closing the valve and opening the valve by the pressure of the injecting fluid acting on the piston overcoming the gas charge.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the method, will be readily apparent to those skilled in the art and which are encompassed within the spirit of the invention and the scope of the appended claims.

What is claimed is:

1. The method of injecting fluid into a well conduit by coil tubing comprising, inserting a coil tubing having a fluid outlet and a valve above the outlet into the well conduit, biasing the valve to the closed position with a sufficient force to at least balance the hydrostatic force of injection fluid in the tubing, inserting a fluid to be injected into the coil tubing, pressuring the fluid in the coil tubing for opening the valve and ejecting the fluid through the fluid outlet, injecting the fluid from the outlet in a circumferential direction from the tubing, and vertically moving the fluid outlet relative to the well conduit while injecting the fluid into the conduit, 2. The method of injecting fluid into a well conduit by coil tubing comprising, inserting a coil tubing having a fluid outlet and a valve above the outlet into the well conduit, biasing the valve to the closed position with a sufficient force to at least balance the hydrostatic force of injection fluid in the tubing, inserting a fluid to be injected into the coil tubing, pressuring the fluid in the coil tubing for opening the valve and ejecting the fluid through the fluid outlet, injecting the fluid from the outlet in a circumferential direction from the tubing, and using upwardly flowing well fluids in the well conduit for dispersing the injected fluids circumferentially around the interior of the well conduit.

3. The method of claim 1 including, wiping the interior of well conduit after injecting the fluid from the fluid outlet for more evenly spreading the injected fluid on the interior of the well conduit.

4. The method of injecting fluid into a well conduit by coil tubing comprising, inserting a coil tubing having a fluid outlet and a valve above the outlet into the well conduit, biasing the valve to the closed position with a sufficient force to at least balance the hydrostatic force of injection fluid in the tubing, inserting a fluid to be injected into the coil tubing, pressuring the fluid in the coil tubing for opening the valve and ejecting the fluid through the fluid outlet, injecting the fluid from the outlet in a circumferential direction from the tubing, said fluid outlet includes a turbine wheel, and rotating the turbine wheel by the injecting fluid.

5. The method of injecting fluid into a well conduit by coil tubing comprising, inserting a coil tubing having a fluid outlet and a valve above the outlet into the well conduit, biasing the valve to the closed position with a sufficient force to at least balance the hydrostatic force of injection fluid in the tubing, inserting a fluid to be injected into the coil tubing, pressuring the fluid in the coil tubing for opening the valve and ejecting the fluid through the fluid outlet, said valve includes a piston actuator, and, biasing the piston by a gas charge for closing the valve, and opening the valve by the pressure of the injecting fluid acting on the piston overcoming the gas charge.

6. An injector valve for use on coil tubing for injecting fluid into a well conduit comprising, a body having connecting means for connection to a coil tubing, said body including a fluid passageway for receiving injecting fluid, and has a fluid outlet connected to the fluid passageway, a piston actuated valve positioned in the fluid passageway upstream of the fluid outlet, biasing means acting on the valve in a direction to close the valve, said piston subject to fluid pressure in the fluid passageway acting in a direction to open the valve, and said fluid outlet directed outwardly from the body around the body circumference for circumferentially spraying the interior circumference of a well conduit.

7. The apparatus of claim 6 including, a turbine impeller positioned in the fluid outlet and rotated by fluid flow through the open valve for rotatively dispersing the fluid.

8. The apparatus of claim 7 including, a well fluid passageway in the body in communication with the turbine wheel for allowing upwardly flowing well fluids in the well conduit to rotate the wheel.

9. The apparatus of claim 6 including, upwardly directed cup means connected to the body for engaging the well conduit.

10. The method of injecting fluid into a well conduit by coil tubing comprising, inserting a coil tubing having a fluid outlet and a valve positioned in the coil tubing above the outlet into the well conduit, said valve including a piston actuator, inserting a fluid to be injected downwardly into the coil tubing, biasing the valve to the closed position with a sufficient force to at least balance the hydrostatic force of injection fluid in the tubing, pressuring the fluid in the coil tubing for opening the valve by the pressure of the injecting fluid acting on the piston actuator overcoming the biasing force, and ejecting the fluid through the fluid outlet, and vertically moving the fluid outlet relative to the well conduit while injecting the fluid into the conduit.

* * * * *

UNITED STATES PATENT OFFICE

CERTIFICATE OF CORRECTION

Patent No. 4,694,908 Dated September 22, 1987

Inventor(s) Arthur J. Morris et al.

It is certified that error appears in the above-identified patent and that said Letters Patent are hereby corrected as shown below:

On face of patent, under inventors, insert -- Ronald E. Pringle, Houston, Tex.

Column 1, line 8, change "economicaly" to -- economically --

Column 1, line 46, delete"injection" and insert -- injecting --

Column 2, line 10, delete "value" and insert -- valve --

Column 3, line 45, delete "nitiated" and insert -- initiated --

Column 5, line 2, delete "," and insert -- . --

Signed and Sealed this

Twenty-sixth Day of April, 1988

*Attest:*

*Attesting Officer*

DONALD J. QUIGG

*Commissioner of Patents and Trademarks*